US005911530A

United States Patent [19]

Hinojosa et al.

[11] Patent Number: 5,911,530

[45] Date of Patent: Jun. 15, 1999

[54] WHEEL-DRIVEN ROTARY CUTTER FOR PRINTER

[75] Inventors: Antonio Hinojosa; Joaquim Brugue; Agusti Garcia, all of Sant Cugat, Spain

[73] Assignee: Hewlett-Packard Company, Palo Alto, Calif.

[21] Appl. No.: 08/921,836

[22] Filed: Sep. 2, 1997

[51] Int. Cl.[6] ..... B41J 11/26

[52] U.S. Cl. ..... 400/621; 83/488; 83/500

[58] Field of Search ..... 83/485, 487, 488, 83/489, 500; 30/265; 400/621; 101/226, 227

[56] References Cited

U.S. PATENT DOCUMENTS

| | | | |
|---|---|---|---|
| 3,771,398 | 11/1973 | Schaefer et al. | 83/302 |
| 4,201,102 | 5/1980 | Rudszinat | 83/298 |
| 4,313,359 | 2/1982 | Smoravek | 83/157 |
| 4,979,838 | 12/1990 | Yokota et al. | 400/621 |
| 4,981,059 | 1/1991 | Kobayashi | 83/76.7 |
| 5,296,872 | 3/1994 | Caamano | 346/24 |
| 5,458,034 | 10/1995 | Cavagna | 83/488 |
| 5,503,053 | 4/1996 | Onishi et al. | 83/488 |

*Primary Examiner*—Edgar Burr
*Assistant Examiner*—Dave A. Ghatt
*Attorney, Agent, or Firm*—David S. Romney

[57] ABSTRACT

A method and apparatus for making a linear cut across stationary media in a printer, particularly applicable to rollfeed media.. A self-contained cutter assembly is activated by a printer carriage to move across a media path through a cutting zone and includes a first wheel-driven rotary cutter which acts cooperatively with a second passive rotary cutter to cut through the media. The first rotary cutter is driven by a concentrically mounted drive tire having a diameter less than the diameter of the first rotary cutter, and is generally positioned under the media path. The second rotary cutter rotates freely, and is generally positioned above the media path. A media guide member on the printer has an output flange with a lower surface for engagement with the drive tire and an upper surface to provide underlying support for the media adjacent the cutting zone. A downwardly biased second tire on the cutter assembly is vertically adjustable to hold media of various thicknesses against the media guide member during a cutting operation. The self-contained cutter assembly is located at a lower end of a rigid arm bracket which slides back and forth along a carnage slider rod.

15 Claims, 14 Drawing Sheets

WHEEL-DRIVEN ROTARY CUTTER FOR PRINTER

BACKGROUND OF THE INVENTION

Printers often provide a cutter which can be used to cut the media without having to remove the media from the printer. This is particularly desirable in large format printers which typically have rollfeed media. Conventional cutters have been mounted on large format printers for either automated or manual actuation to pass a cutting blade across the media after a printing operation is completed. Some rotary cutting blades have been used in conjunction with fixed linear blades on the printer, and various techniques have been used to hold the media in position during a cutting operation. However, such prior cutters have either been overly expensive and complicated, or have not provided precise and reliable cutting of the media.

Accordingly there is a need for a simplified cutter that provides automated cutting using a self-contained cutter assembly which employs rotary blades and rotating wheels to traverse across printed media while providing a satisfactory cutting operation.

BRIEF SUMMARY OF THE INVENTION

A method and apparatus for making a linear cut across stationary media in a printer, particularly applicable to rollfeed media.. A self-contained cutter assembly is activated by a printer carriage to move across a media path through a cutting zone and includes a first wheel-driven rotary cutter which acts cooperatively with a second passive rotary cutter to cut through the media. The first rotary cutter is driven by a concentrically mounted drive tire having a diameter less than the diameter of the first rotary cutter, and its axis is positioned under the media path. The second rotary cutter is driven by the friction with the first rotary blade, and its axis is positioned above the media path. A media guide member on the printer has an output flange with a textired where the drive tire rotates and an upper surface to provide underlying support for the media adjacent the cutting zone. A downwardly biased second tire on the cutter assembly is vertically adjustable to hold media of various thicknesses against the media guide member during a cutting operation. The second tire on the cutter assembly is pressed by a wire spring in order to reference the media to the upper surface of the guide and to provide the necessary friction to make the first tire rotate. The self-contained cutter assembly is located at a lower end of a rigid arm bracket which slides back and forth along a carriage slider rod.

DETAILED DESCRIPTION OF PREFERRED EMBODIMENTS

Figure 1:
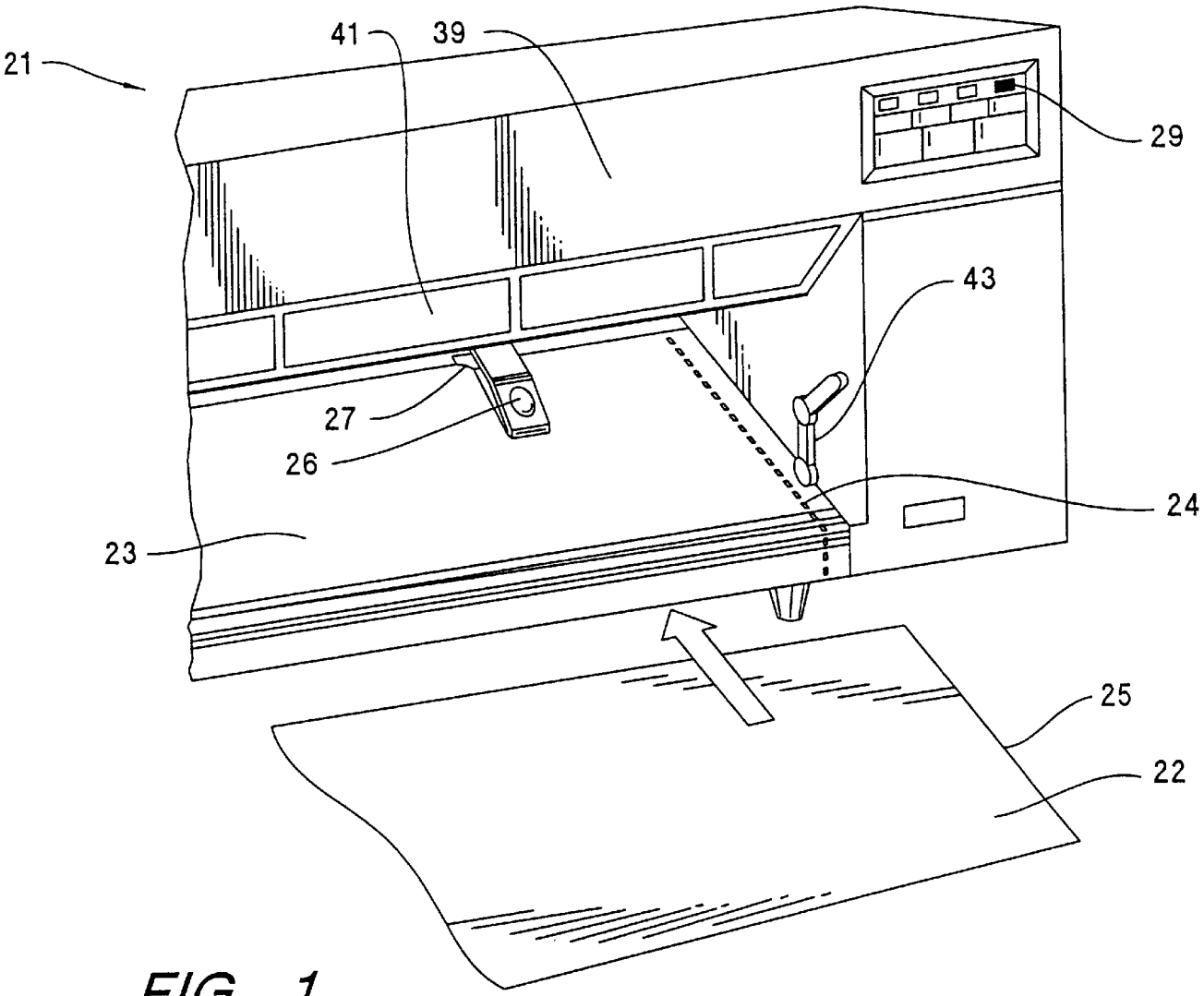
FIG. 1 is a fragmented pictorial view showing a printer which incorporates the present invention with an active deflector guide.

Referring now to FIGS. 1–4 in the drawings, the invention is applicable to a printer such as a large format inkjet printer 21 into which printing media such as sheet 22 may be fed along a media path leading to a print zone (not shown). A front input platen 23 for the printing media has on one side an alignment of reference marks 24 which may be formed by small holes, for enabling a corresponding side edge 25 of the printing media to be aligned at the moment when it is introduced into the front portion of the printer. The manual feeding operation for loading the printing media into the machine therefore involves the alignment of the edge 25 with the reference line (See FIG. 2). As part of the media feeding procedures, the operator must ensure that a front leading edge of the printing media is suitably positioned without substantial deviation. This entire operation takes place with the printing-media entrainment rollers (typically a pick-roller and opposing pinch rollers) stationary to allow the operator to manipulate the printing media properly as it enters the machine. Only when the operator has ensured that the printing media is suitably positioned at the input of the machine does he operate a control button for activating the drive motor of the printing media entrainment rollers. In the embodiment shown in the drawings, a push-button 26 is incorporated in an active deflector guide 27 which acts as a deflector for both the input and output of the printing media. This arrangement considerably facilitates the manual operation of the activation push-button. However, the push-button may be disposed in any other position on the machine, for example, on the instrument panel 29 or in another suitable place, as appropriate for the general configuration of the machine or for the way in which it operates.

Figure 2:
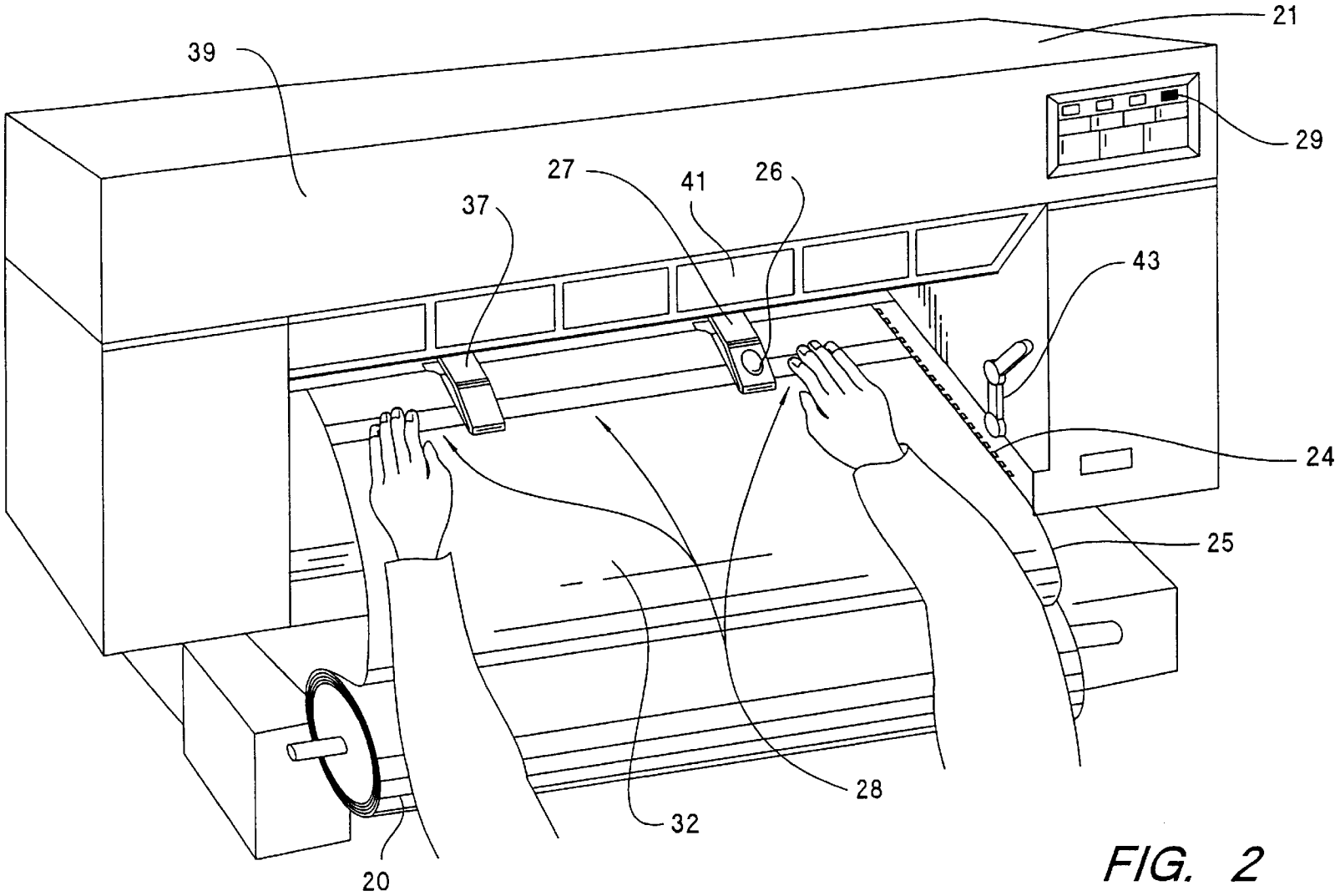
FIG. 2 shows a front pictorial view of a rollfeed printer which incorporates the present invention, with a user manually feeding a leading edge of rollfeed media past two deflector guides.
Figure 3:
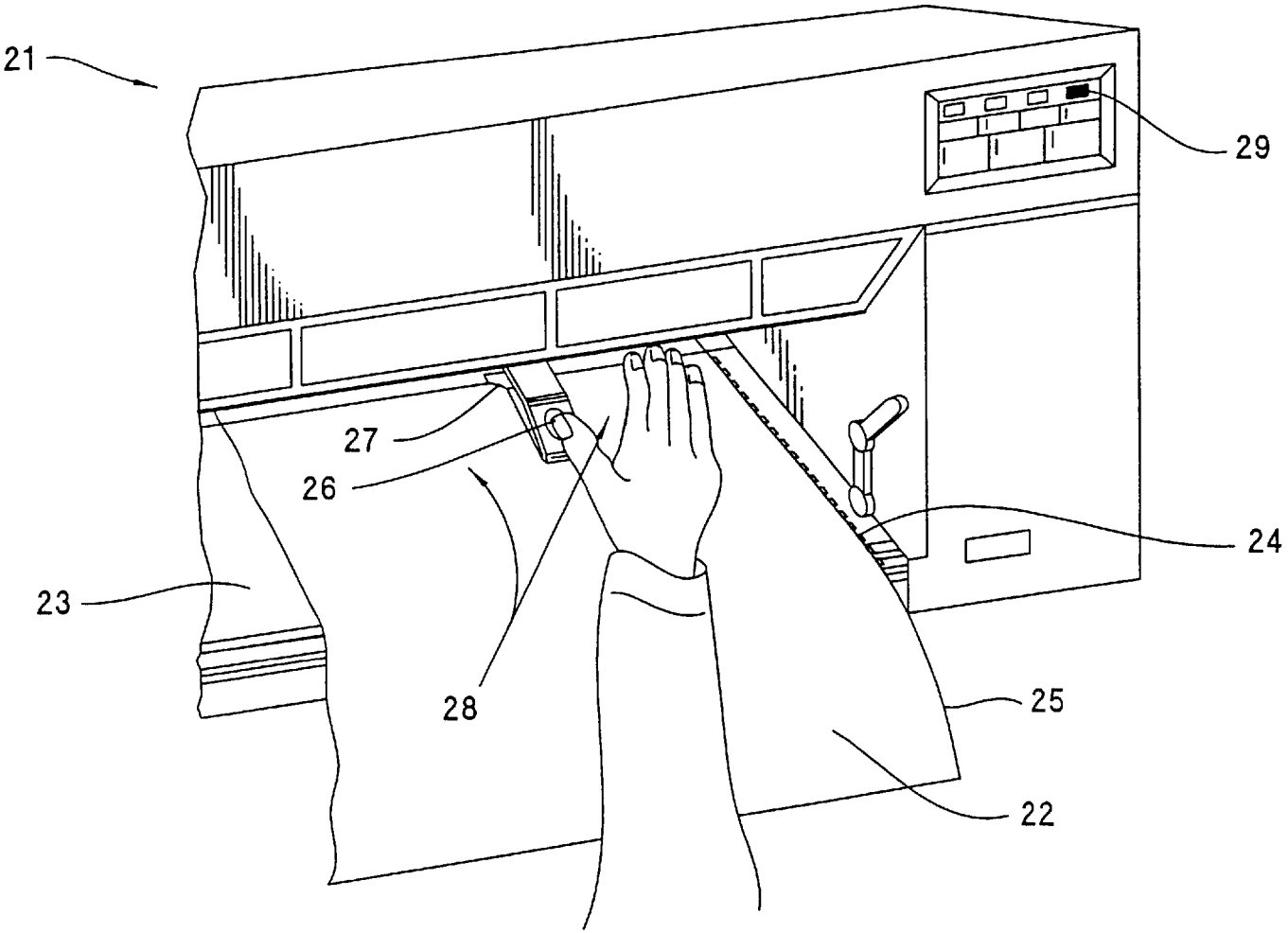
FIG. 3 shows the pictorial view of FIG. 1 with a leading edge of media in position for being pulled into a media path, upon activation of a control button on an active deflector guide by a user without having to remove the right hand from holding the media against an input platen.
Figure 4:
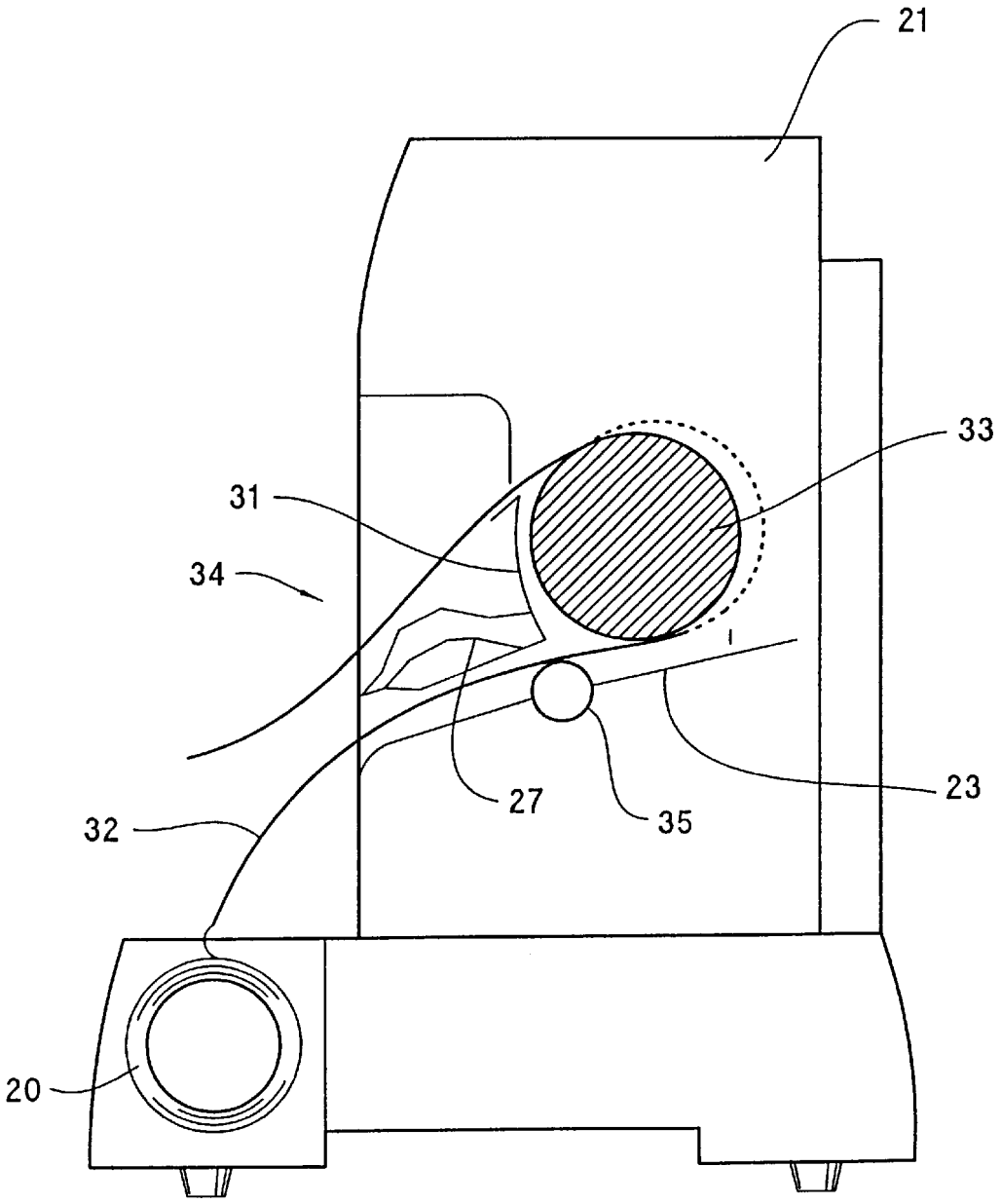
FIG. 4 is a schematic view partially in cross-section showing a media path for passing rollfeed media through the printer of FIGS. 1–3.

As can be seen from FIGS. 2 and 4, the rollfeed printing media 32 can proceed from a roll 20 past a deflector guide 27 and media shield 31 along an input platen 23 to an entry slot between a main roller 33 and pinch wheel 35 for passing the media past a print zone (not shown) to an output path 34. The space 28 between or adjacent to the deflector guides (active 27 and passive 37) is available for placing one or both hands directly on top of the media to guide its leading edge up to the input slot. Even when the printer top 39 is closed, it is still possible see the media through a transparent window 41 on the front of the printer top. Also, one of the manual access spaces 28 on the right side of the input platen is very close to a pinch wheel release lever 43 for moving the pinch wheels between an engagement and disengagement position.

Figure 5:
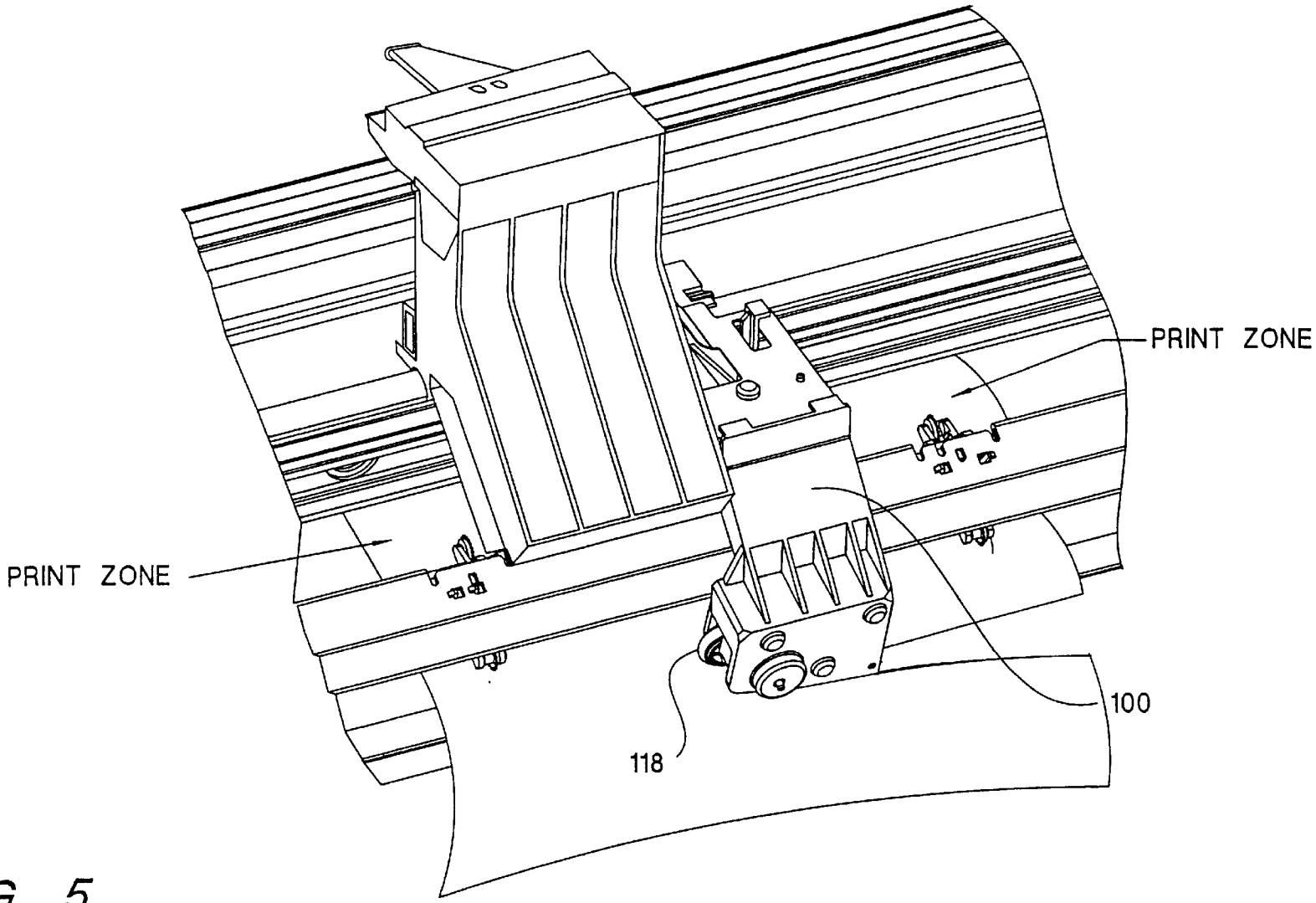
FIG. 5 is a fragmented perspective view showing a preferred embodiment of a cutter assembly which has been moved by a motorized printer carriage from right to left to cut off a section of media which has passed through a print zone of the printer.
Figure 8:
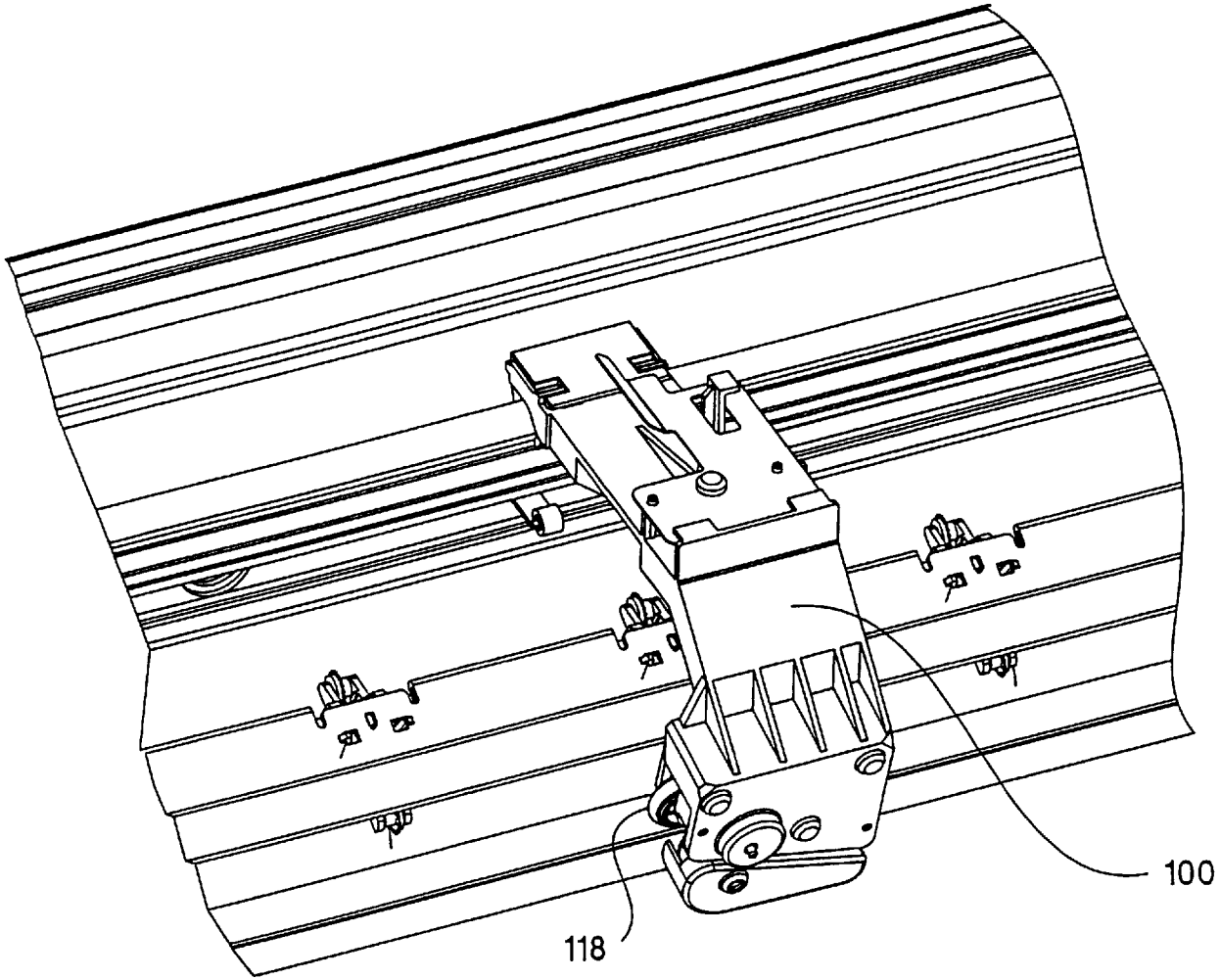
FIG. 8 is an enlarged fragmented perspective view showing the preferred embodiment of the cutter assembly of FIG. 5 slidably mounted on a carriage support rod.
Figure 9:
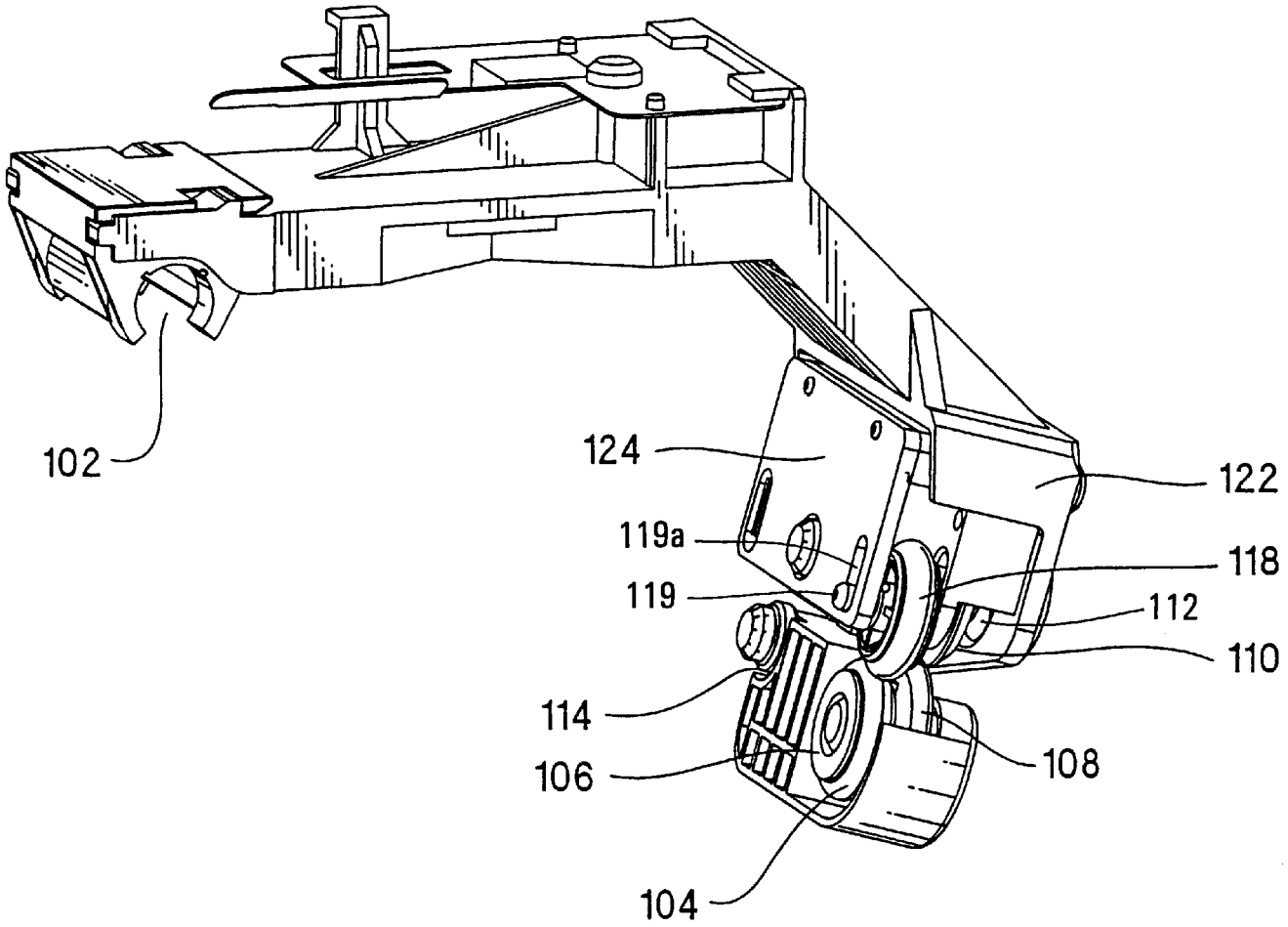
FIG. 9 is a perspective view of the cutter assembly of FIG. 5.
Figure 10:
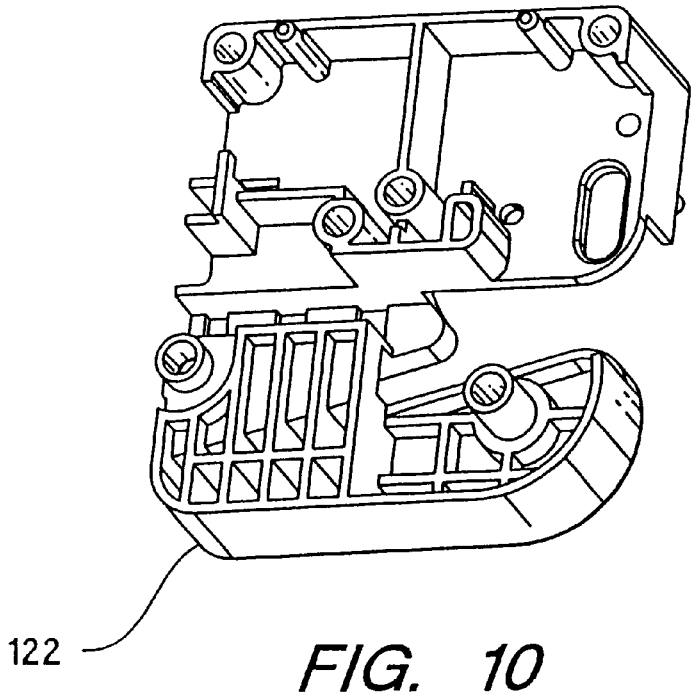
FIG. 10 is an enlarged internal view of a cutter housing without any wheels or cutting blades.
Figure 11:
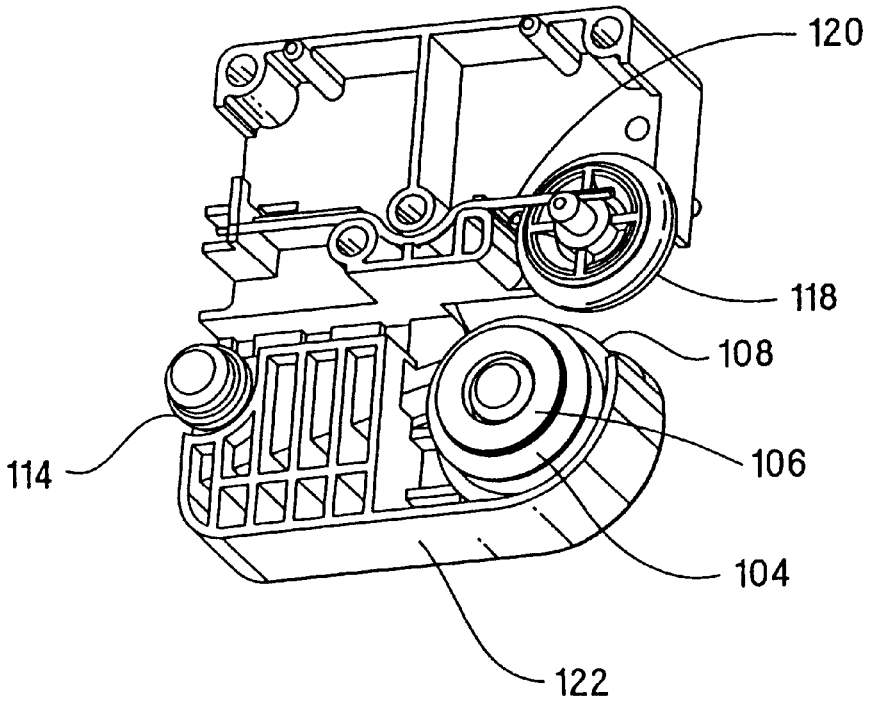
FIG. 11 shows the internal view of the cutter housing of FIG. 10 with one rotary cutting blade, three wheels and a downward biasing spring mounted therein.
Figure 12:
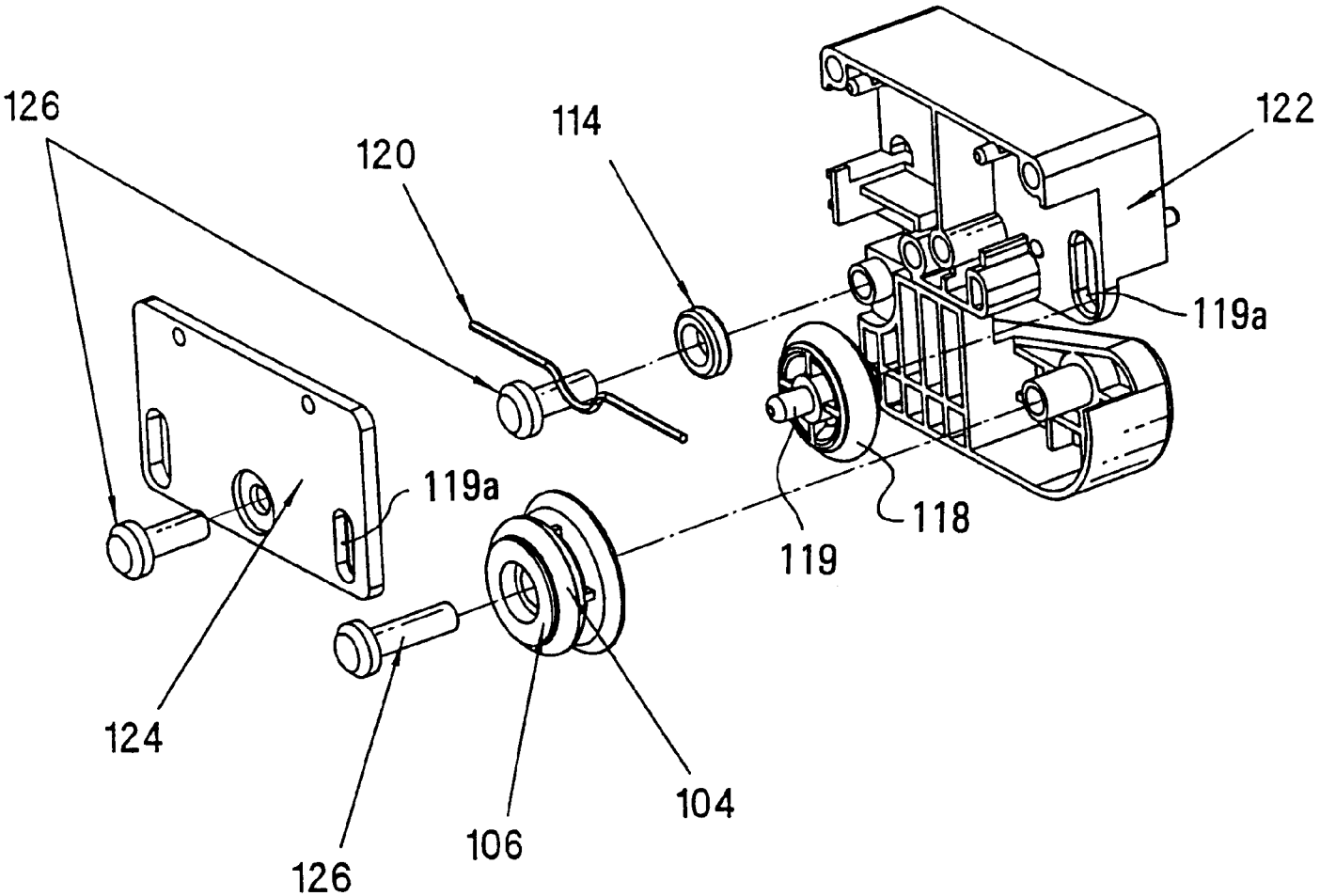
FIG. 12 shows an exploded view of FIG. 11 with a head cover and mounting screws included.
Figure 13:
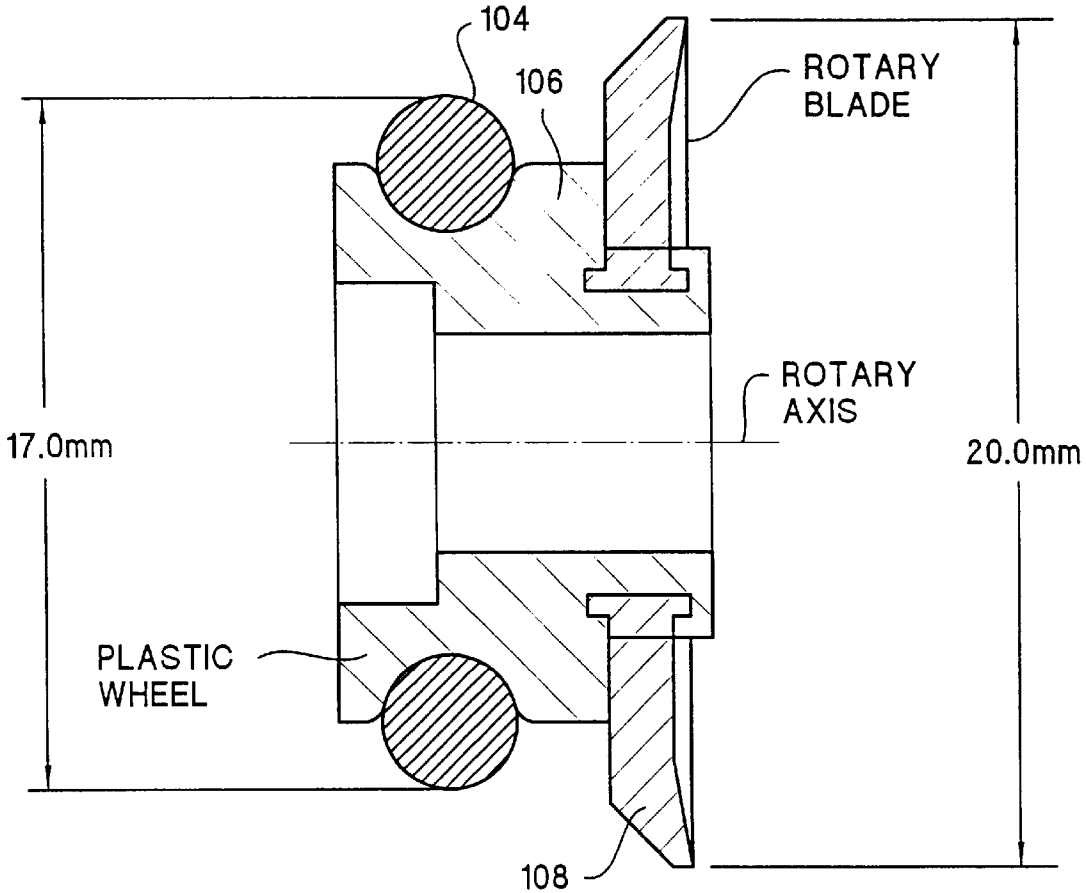
FIG. 13 is a partial sectional view of a combined drive wheel/rotary cutter.
Figure 14:
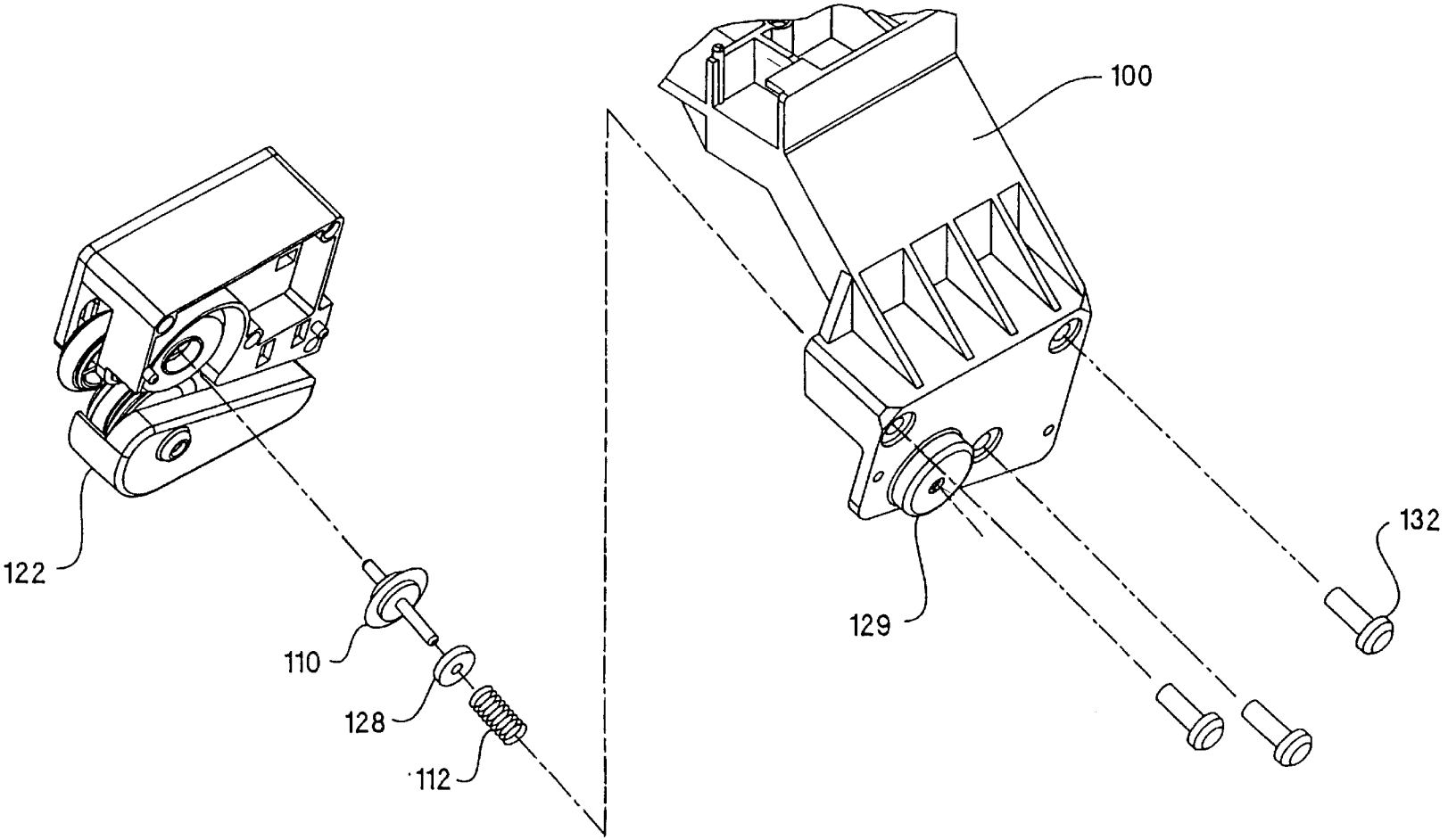
FIG. 14 is an exploded view showing how the components of FIG. 12 are attached with a second rotary cutter to one end of a cutter arm.

FIGS. 5, 8 and 9 show the details of the fully operating cutter assembly which is retrieved from a parking position by the carriage in a manner previously implemented in the previous DesignJet large format printers.

Figure 7:
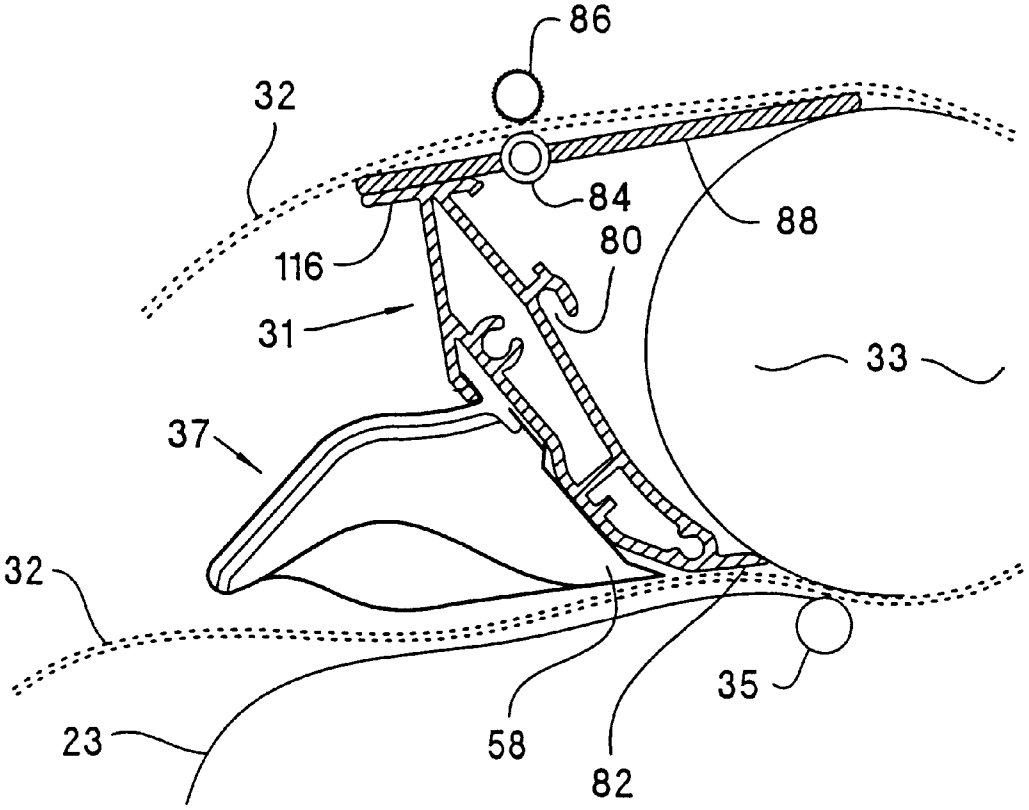
FIG. 7 is a partial sectional view showing the guide platen of FIG. 6 integrated with the input and out paths for media passing through the printer.
Figure 6:
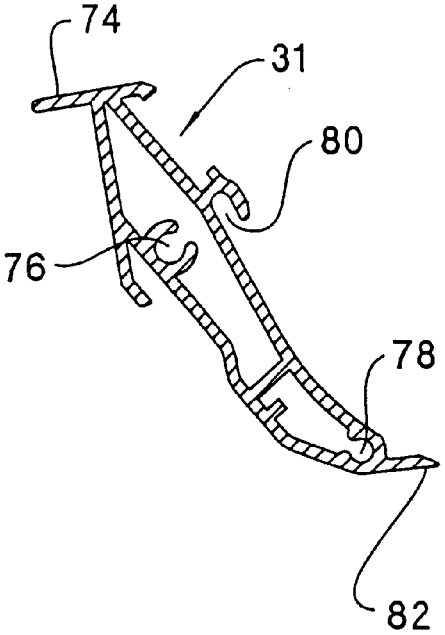
FIG. 6 is a right end view of a guide platen for the cutter assembly as shown in FIG. 5.

FIGS. 6–7 show the details of the media shield 31, including an output platen 74 having an upper surface and a lower surface 116, central and bottom mounting screw holes 76, 78, rear mounting slot 80 for hanging on right and left printer frame pins (not shown), and input slot guide 82 which aligns with rear edge 58 to provide a continuous guide into the pinch wheels/pick roller portion of the media path. The output path may include output rollers 84, star wheels 86, and a flexible mylar paper separator 88. The upper and lower surfaces of platen 74 are engaged by upper and lower tires 118, 104 respectively, of a cutter assembly such that the output platen 74 functions as a guide member for the cutter assembly.

FIGS. 10–14 show the details of the mounting of cutter blades and wheels within the casing and housing components of the cutter assembly.

Figure 15A:
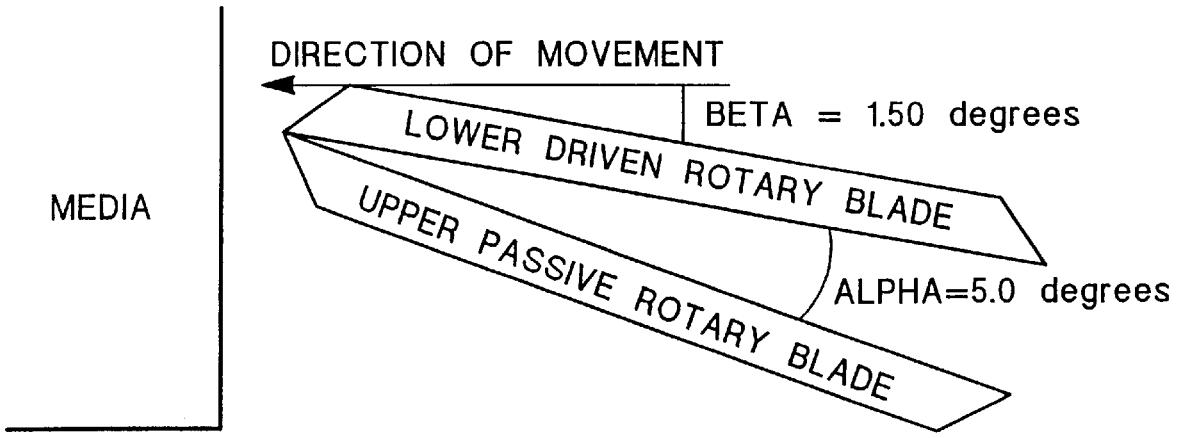
FIG. 15A is a schematic diagram showing preferred angles of inclination for two rotary cutting blades.
Figure 15B:
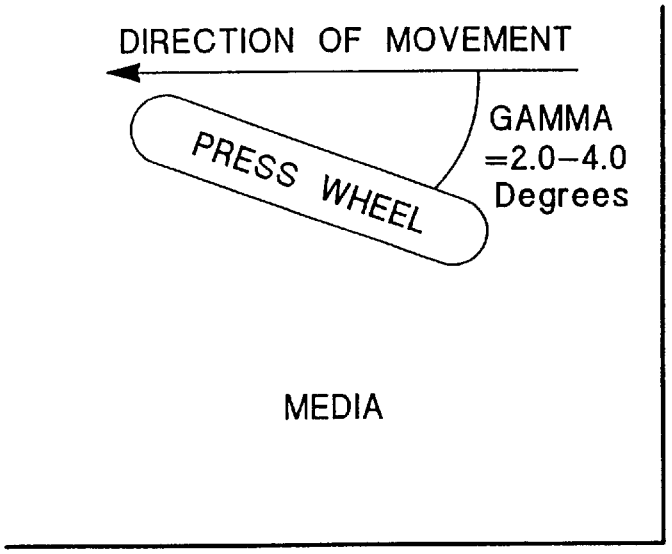
FIG. 15B is a schematic diagram showing a preferred range of angles of inclination for a media press wheel.

FIGS. 15A and 15B show the specific angular declinations of the cutter blades and wheels. In that regard, the amount of overlap between the two rotary cutter blades determines the angle of deflection of the cut media passing from the cutter assembly, which in the preferred embodiment is approximately 13 degrees.

Figure 16:
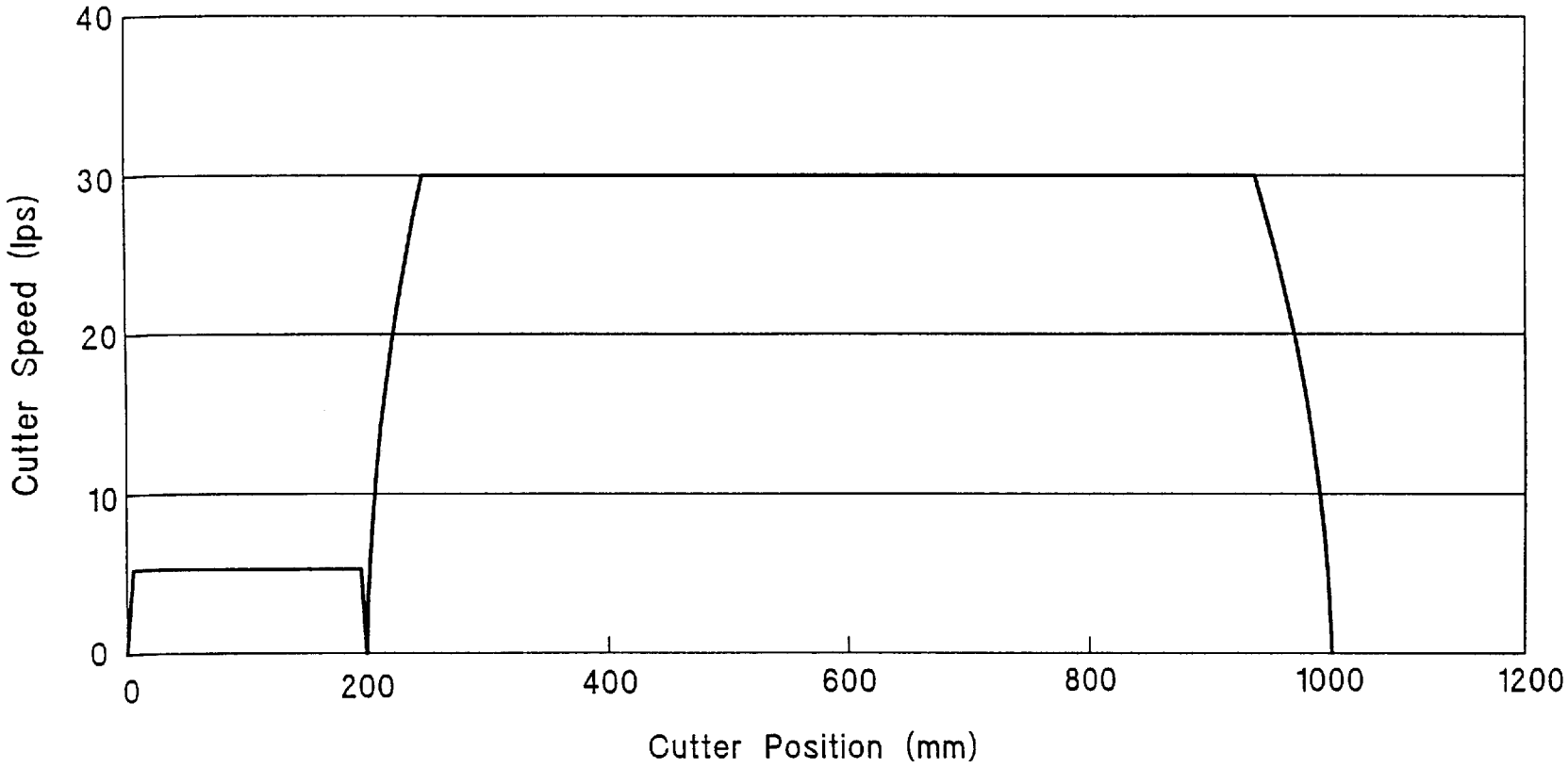
FIG. 16 is a graph showing preferred traversing speeds for the cuter assembly during a cutting operation.

FIG. 16 shows that a preferred initial translational speed of the cutter assembly at the time of first encountering the media to be cut is 5 ips, while thereafter the preferred speed through the rest of the cutting operation is 30 ips.

It will be understood from the drawings that the cutter arm 100 rides on the same slider bar as the carriage through bushing 102, and carries cutter components lower driven tire 104 having a central wheel 106 and concentric driven rotary blade 108, as well as upper rotary blade 110 which is biased by spring 112 against the driven blade. An additional positional tire 114 is provided which is periodically engaged by the underside 116 of the output platen 74 which is textured by painting, taping, machining or knurling to assure maintenance of the proper frictional contact with the drive tire. The upper tire 118 is mounted on an axle 119 (FIGS. 9 and 12) the ends of which are received in vertically extending slots 119*a* in the housing walls, tire 118 being downwardly biased by spring 120 which is mounted along with the other aforesaid components in housing 122. Upper tire 118 is thus vertically adjustable to hold media of various thicknesses in the printing zone. A side plate 124 and related mounting screws 126 provide attachment and bearing functions for the various components. An additional biasing spring 128 acts against the second rotary blade 130 by virtue of additional mounting screws 132.

The lower cutter blade 108 is affixed to a drive wheel 106 having a drive tire 104 on the periphery of wheel 106. Engagement of drive tire 104 with the lower surface 116 of the printer output platen 74 causes rotation of the lower cutter blade 108 as the cutter assembly moves across the output path of the media to be cut.

Automated cutting of media passing along a paper path which extends over the output platen 74 is achieved by transporting the media through a print zone to create printed media and thereafter transporting the media to a cutting zone where the printed media is maintained in a stationary position for cutting by the rotation of cutter blade 108 caused by rotation of the drive tire 104 to which blade 108 is connected as the cutter assembly is moved across the media to be cut.

Automated cutting of media passing along a printing path in a printer is comprised of the steps of:

passing media through a print zone to create printed media; and thereafter transporting the printed media to a cutting zone;

maintaining the printed media in a stationary position;

holding the printed media with a rotating holding tire against a media guide near the cutting zone;

rotating a drive tire which drives a rotary cutting blade;

moving both the holding tire, the drive tire, and the rotary cutting blade together across the printed media during said maintaining, holding and rotating steps in order to cut the printed media in the cutting zone.

Movement of the cutter assembly including tires and cutting blade across the printed media may be performed with any type of cutter carriage drive including automated or manual.

It will therefore be appreciated by those skilled in the art that a compact yet sophisticated cutter assembly is provided for manual or preferably automated cutting of media in a printer, all as set forth in the following claims.

We claim as our invention:

1. A printer for cutting through media as it passes along a media path, comprising:

a printer frame having a media path for directing media in a given direction along a media path;

a guide member on said printer frame extending across a cutting zone in said media path;

an arm member mounted relative to said printer frame for lateral movement in a cutting direction across said media path; and a cutter assembly on said arm member, including a driven rotary cutter below said media path and a drive tire axially coupled to said driven rotary cutter, said drive tire being rotated by contact with a lower surface of said guide member during movement of said cutter assembly and wherein said cutter assembly further includes a second tire engageable with an upper surface of said guide member and moveable across the media with the cutter assembly for holding media in position in said cutting zone during a cutting operation.

2. The printer of claim 1 wherein said drive tire is co-axially mounted with said driven rotary cutter.

3. The printer of claim 1 wherein said driven rotary cutter has a diameter greater than said drive tire in order to ensure that the speed of a point on the edge of the cutter is greater than the linear speed of the cutter assembly across the cutting zone.

4. The printer of claim 1 wherein said cutter assembly further includes a second cutter element positioned for cooperative engagement with said driven rotary cutter to cut media passing therebetween.

5. The printer of claim 4 wherein said second cutter element includes a freely rotating cutter mounted on said cutter assembly to freely rotate during a media cutting operation activated by the friction with said driven rotary cutter and a compression spring urging said freely rotating cutter against said driven rotary cutter.

6. The printer of claim 1 wherein said drive tire is concentrically mounted with said driven rotary cutter on a single wheel.

7. The printer of claim 6 wherein said drive tire is elastomeric and said wheel is plastic.

8. The printer of claim 1 further including a second rotary cutter mounted on said cutter assembly above said media path for cooperative engagement with said driven rotary cutter.

9. The printer of claim 1 wherein said second tire is rotatable about an axle, said axle having ends received in vertically elongated slots in said housing, whereby said second tire is vertically self adjusting to accommodate and hold media of various thickness in position in said cutting zone.

10. The printer of claim 1 further comprising resilient means for biasing said ends of said axle in said slots toward said guide member in order to securely hold media in position in said cutting zone by pressing directly against the media, and also to ensure rolling frictional contact between the drive tire and said lower surface of said guide member.

11. The printer of claim 1, which further includes a motor-driven carriage connected to said arm member doe moving said cutter assembly in a cutting direction across said media path.

12. The printer of claim 1 wherein at least a portion of said surface engageable with said drive tire is textured.

13. A method of automated cutting of media passing along a printing path in a printer comprising the steps of:

passing media a through a print zone to create printed media; and thereafter transporting the printed media to a cutting zone;

maintaining the printed media in a stationary position;

holding the printed media with a rotating holding tire against a media guide near the cutting zone;

rotating a drive tire which drives a rotary cutting blade;

moving both the holding tire, the drive tire, and the rotary cutting blade together across the printed media during said maintaining, holding and rotating steps in order to cut the printed media in the cutting zone.

14. The method of claim 13, wherein said moving step includes moving the rotary cutting blade across the printed media at a first speed when the rotary cutting blade first encounters an edge of the printed media, and thereafter moving the rotary cutting blade across the printed media at a second speed greater than the first speed.

15. The method of claim 13, which further includes engaging the media between the rotary cutting blade and a second cutting element during said moving step, moving the media backwards after finishing the cutting, and then returning the cutter to a parking position.

* * * * *